US010132582B1

(12) United States Patent
Zhou

(10) Patent No.: US 10,132,582 B1
(45) Date of Patent: Nov. 20, 2018

(54) SYSTEM FOR RAPIDLY RELOADING REMOVABLE AMMUNITION MAGAZINES

(71) Applicant: Junsheng Zhou, Bensalem, PA (US)

(72) Inventor: Junsheng Zhou, Bensalem, PA (US)

( * ) Notice: Subject to any disclaimer, the term of this patent is extended or adjusted under 35 U.S.C. 154(b) by 0 days.

(21) Appl. No.: 15/978,086

(22) Filed: May 11, 2018

Related U.S. Application Data

(63) Continuation-in-part of application No. 15/842,874, filed on Dec. 14, 2017, now Pat. No. 9,995,548.

(51) Int. Cl.
*F41A 9/83* (2006.01)

(52) U.S. Cl.
CPC ..... *F41A 9/83* (2013.01)

(58) Field of Classification Search
CPC ..... F41A 9/82; F41A 9/83; F41A 9/84; F41A 9/66; F41A 9/67
USPC ..... 42/87, 88
See application file for complete search history.

(56) References Cited

U.S. PATENT DOCUMENTS 452,447 A 5/1891 Bruce
1,786,537 A * 12/1930 Holek ..... F41A 9/83 42/87
2,356,806 A 8/1944 Woodberry
2,402,195 A 6/1946 Woodberry
2,403,012 A 7/1946 McPheters
2,451,521 A * 10/1948 Uglum ..... F41A 9/83 244/155 A
2,542,842 A 2/1951 Saunders
2,887,811 A 5/1959 Johnson, Jr.
2,981,024 A 4/1961 Skoff
3,283,425 A 11/1966 Boyd
4,538,371 A 9/1985 Howard
4,574,511 A 3/1986 Csongor
4,614,052 A 9/1986 Brown et al.
4,706,402 A * 11/1987 Csongor ..... F41A 9/84 42/87
4,707,941 A 11/1987 Eastman
4,939,862 A * 7/1990 Brandenburg ..... F41A 9/83 42/87
5,301,449 A * 4/1994 Jackson ..... F41A 9/83 42/87
5,747,718 A 5/1998 Bill
6,257,115 B1 * 7/2001 Balsavage ..... F41A 9/12 42/39.5
9,335,108 B2 * 5/2016 Cauley, Jr. ..... F41A 9/83
9,354,008 B1 * 5/2016 Cifers ..... F41A 9/83
(Continued)

*Primary Examiner* — Derrick R Morgan
(74) *Attorney, Agent, or Firm* — LaMorte + Associates, P.C.

(57) ABSTRACT

A reloading system and method for reloading cartridges into an ammunition magazine. The reloading system has a storage container for holding a supply of cartridges. The internal chamber supplies a set number of cartridges to a loading chamber. A first spring-loaded plunger extends into the loading chamber from a first end. The first spring loaded plunger biases the set number of cartridges in the loading chamber toward the second end. A magazine receptacle is offset from the second end of the loading chamber. A second spring loaded plunger is provided that extends into the loading chamber proximate the second end. The second spring loaded plunger advances one of the cartridges from the loading chamber into the ammunition magazine that is engaged with the magazine receptacle. A new cartridge is loaded each time the second spring loaded plunger is manually advanced.

13 Claims, 5 Drawing Sheets

(56) References Cited

U.S. PATENT DOCUMENTS

| | | | | |
|---|---|---|---|---|
| 9,574,836 | B1 | 2/2017 | Cauley, Jr. | |
| 9,689,633 | B1 | 6/2017 | Plate | |
| 9,719,741 | B1 * | 8/2017 | Cifers | F41A 9/83 |
| 9,846,005 | B2 * | 12/2017 | Zivic | F41A 9/83 |
| 9,995,548 | B1 * | 6/2018 | Zhou | F41A 9/83 |
| 2013/0067788 | A1 * | 3/2013 | Gray | F41A 9/84 42/88 |
| 2014/0033592 | A1 | 2/2014 | Fiorucci | |
| 2014/0298704 | A1 * | 10/2014 | Niccum | F41A 9/83 42/87 |
| 2014/0317985 | A1 | 10/2014 | Cauley, Jr. | |
| 2014/0373421 | A1 | 12/2014 | Hatch | |
| 2015/0377573 | A1 * | 12/2015 | Niccum | F41A 9/83 42/87 |

* cited by examiner

SYSTEM FOR RAPIDLY RELOADING REMOVABLE AMMUNITION MAGAZINES

RELATED APPLICATIONS

This application is a continuation in part of co-pending U.S. patent application Ser. No. 15/842,874, filed Dec. 14, 2017.

BACKGROUND OF THE INVENTION

1. Field of the Invention

In general, the present invention relates to systems and methods for rapidly reloading ammunition into the removable magazine of a rifle or pistol. More particularly, the present invention relates to portable systems that hold a large number of ammunition cartridges, wherein the system can be repeatedly used to rapidly refill an ammunition magazine by a soldier in the field.

2. Prior Art Description

Many makes and models of rifles and pistols are loaded using removable ammunition magazines. An ammunition magazine is a plastic or metal structure that is generally shaped like a box. The magazine has one open end. Inside the magazine is a spring biased platform. As cartridges are inserted into the magazine, the cartridges displace the platform against the spring bias. Once inserted into the magazine, the cartridges are biased toward the open end of the magazine. When the magazine is inserted into a rifle or pistol, the open end of the magazine is exposed to the breech of the gun. As the gun cycles, a cartridge is mechanically extracted from the magazine and loaded for firing.

The use of ammunition magazines is popular because it greatly decreases the amount of time and labor that is involved with reloading a gun. Using replaceable magazines, a rifle or pistol can be fully reloaded in only a few seconds. As a gun is being loaded, it cannot be fired. As such, it is very important to military personnel and law enforcement that the time required to reload the gun is minimal.

One disadvantage of using removable ammunition magazines is that it takes a significant amount of time and labor to reload the magazine after the magazine is emptied. Accordingly, soldiers, police officers and the like do not attempt to reload empty magazines while in dangerous situations. Rather, soldiers and police officers prefer to carry a few preloaded magazines. When the magazines are empty, the soldier or officer is out of ammunition and must retreat to a safe location to either reload the empty magazines or to obtain additional preloaded magazines.

In the prior art, there are a myriad of devices that exist to reduce the time and labor needed to reload an ammunition magazine. Many of these devices are not designed to be portable and are impractical for use by a soldier or an officer in the field. Most such prior art devices, require the pressing of a lever or the turning of a crank to advance cartridges into an empty magazine. This requires concentration to operate and distracts the soldier or officer from his/her surroundings. Obviously, this is undesirable on a battlefield or other dangerous situations. Prior art magazine reloading devices that require two hands to operate are exemplified by U.S. Pat. No. 4,574,511 to Csongor and U.S. Patent Application No. 2014/0033592 to Fiorucci.

Another disadvantage of prior art magazine reloading systems is that they typically only hold enough ammunition to reload a magazine one or two times. Since the reloading system is typically significantly larger than a magazine, it is much more practical to carry one or two extra pre-filled magazines than it is to carry one magazine reloading system.

A need therefore exists for a magazine reloading system that has the capacity and size to make it more practical to carry than pre-filled magazines. A need also exists for a magazine reloading system that refills an empty magazine in only a few seconds and can be operated with only one hand. These needs are met by the present invention as described and claimed below.

SUMMARY OF THE INVENTION

The present invention is a reloading system and method for reloading cartridges into a removable ammunition magazine of a gun. The reloading system has a storage container that defines an internal compartment for holding a supply of cartridges. The internal chamber supplies a set number of cartridges to a loading chamber. The loading chamber has a first end and an opposite second end. A first spring-loaded plunger extends into the loading chamber from the first end. The first spring loaded plunger biases the set number of cartridges in the loading chamber toward the second end.

A magazine receptacle is offset from the second end of the loading chamber. The magazine receptacle is configured to receive the ammunition magazine.

A second spring loaded plunger is provided that extends into the loading chamber proximate the second end. The second spring loaded plunger advances one of the cartridges from the loading chamber into the ammunition magazine that is engaged with the magazine receptacle. A new cartridge is loaded each time the second spring loaded plunger is manually advanced.

After the magazine is filled, the magazine is removed from the loading chamber, wherein the cartridges remain within the magazine.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention magazine reloading system can be used to reload many types of removable ammunition magazines, the magazine reloading system is shown in only one illustrated embodiment. The exemplary embodiment shows the magazine reloading system being used to reload a magazine with a capacity of seven rounds. The embodiment is selected for ease of description and illustration, wherein the exemplary embodiment sets forth one of the best modes contemplated for the invention. The illustrated embodiment, however, is merely exemplary and should not be considered a limitation when interpreting the scope of the appended claims.

Figure 2:
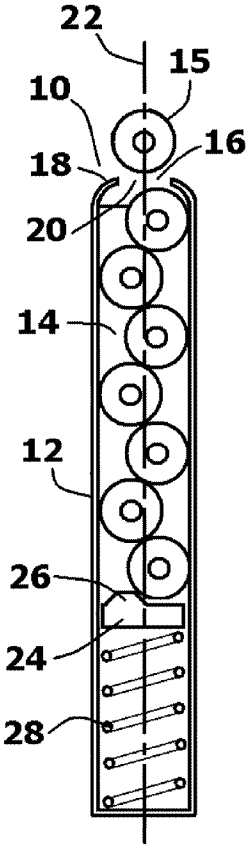
FIG. 2 Prior Art
FIG. 2 is a cross-sectional view of the embodiment of FIG. 1 viewed on section line 2-2.
Figure 1:
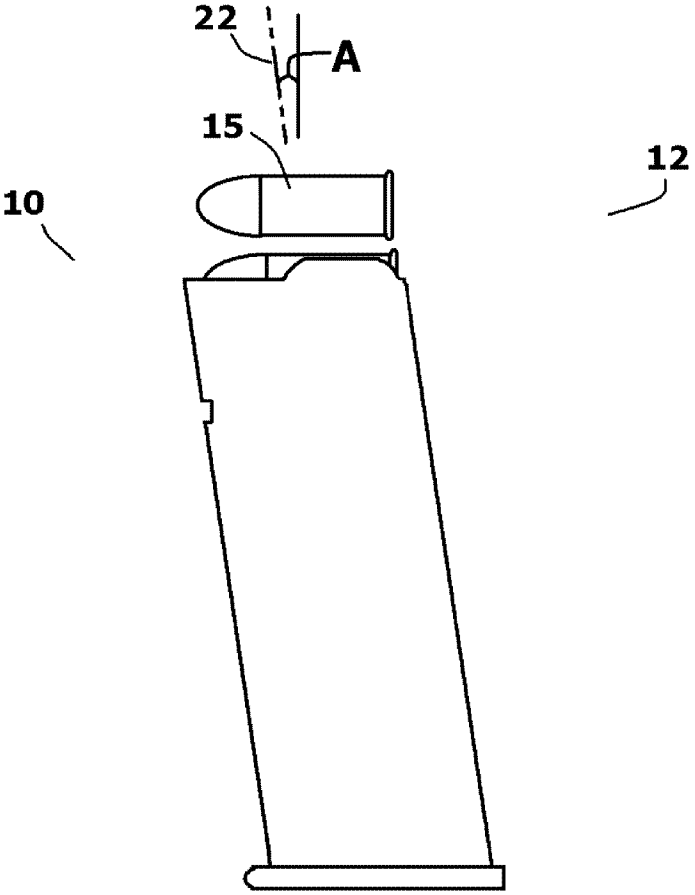
FIG. 1 Prior Art
FIG. 1 is a side view of a prior art ammunition magazine.

Referring to FIG. 1 in conjunction with FIG. 2, a prior art removable ammunition magazine 10 is shown. The ammunition magazine 10 has a housing 12. The housing 12 is typically metal or molded plastic. The housing 12 defines an internal chamber 14 that is sized to retain the ammunition cartridges 15 of a particular length and caliber. The internal chamber 14 is accessed through an opening 16 at one end of the housing 12. The opening 16 is partially obstructed by flared stops 18 that overlap sections of the opening 16. The flared stops 18 are positioned on opposite sides of the opening 16. The flared stops 18 extend a first distance over the opening 16. A gap space 20 exists between the flared stops 18. The gap space 20 is aligned with the centerline 22 of the internal chamber 14. The centerline 22 is offset by an angle A from the vertical. The angle A of the offset is determined by the make, model and caliper of the ammunition magazine 10. The gap space 20 is just wide enough to enable a cartridge 15 to pass through the gap space 20. In this manner, cartridges 15 can be loaded into the magazine 10 by manually advancing the cartridges 15 through the gap spaces 20.

Inside the internal chamber 14 is a platform 24. The platform 24 has a contoured surface 26. The contoured surface 26 causes any cartridge 15 that may be resting on the platform 24 to be positioned off-center from the centerline 22 of the internal chamber 14. In this manner, the cartridges 15 within the housing 12 do not directly align with the gap space 20 between the flair stops 18. This prevents the cartridges 15 from falling out of the magazine 10 through the gap space 20. The platform 24 is biased toward the opening 16 by a spring 28. Accordingly, any cartridge 15 resting on the contoured platform 24 is also biased toward the opening 16. Due to the offset of the cartridges 15 caused by the contoured surface 26 of the platform 24, the cartridges 15 become wedged under the flared stops 18 and are prevented from falling out of the magazine 10.

Figure 3:
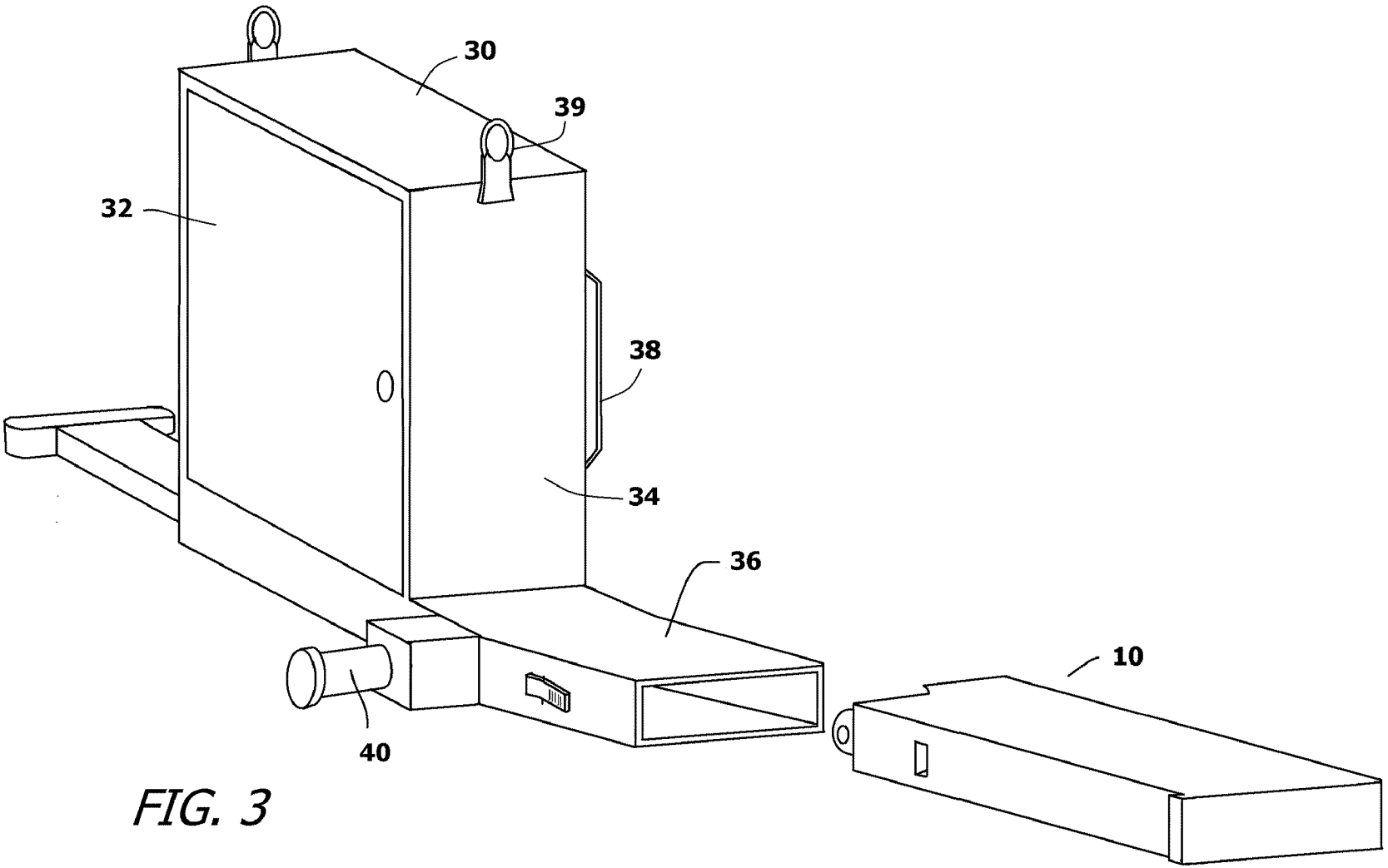
FIG. 3 shows the present invention reloading system in conjunction with the ammunition magazine of FIG. 1.

Referring to FIG. 3 in conjunction with FIG. 2, a reloading system 30 is shown. The reloading system 30 includes a refillable storage container 32. The storage container 32 has the capacity to hold a large number of cartridges 15 arranged in parallel. The storage container 32 has a side wall 34. A loading port 36 extends from the side wall 34. The loading port 36 is sized and shaped to receive the magazine 10. The magazine 10 is pressed into the loading port 36 so that the opening 16 of the magazine 10 enters the loading port 36 first. The loading port 36 may contain a locking mechanism to lock the magazine 10 in place within the loading port 36. The locking mechanism would be the same as is used on the firearm to lock the magazine 10 in place. As such, different locking mechanisms in different locations would be used for different models of magazines 10.

As the magazine 10 enters the loading port 36, cartridges 15 are automatically positioned to be loaded into the magazine 10. The actual loading of the cartridges 15 into the ammunition magazine 10 occurs as a small spring-loaded plunger 40 is depressed. The spring-loaded plunger 40 can be depressed as rapidly as a person is capable of pressing and releasing the small spring-loaded plunger 40. Accordingly, a few cartridges 15 can be loaded into the ammunition magazine 10 in a second. A seven-round magazine can be refilled in about 2-3 seconds. As a result, an empty magazine 10 can be reloaded nearly as fast as the magazine 10 can be replaced with another. The need to carry multiple magazines is, therefore, eliminated. A user need only carry the reloading system 30 and can reload the same magazine 10 multiple times.

The reloading system 30 is designed to be carried into action by a soldier or an officer. As such, the reloading system 10 can have belt loops 38, shoulder strap loops 39 or other such external features that enable the reloading system 30 to be easily carried.

Figure 4:
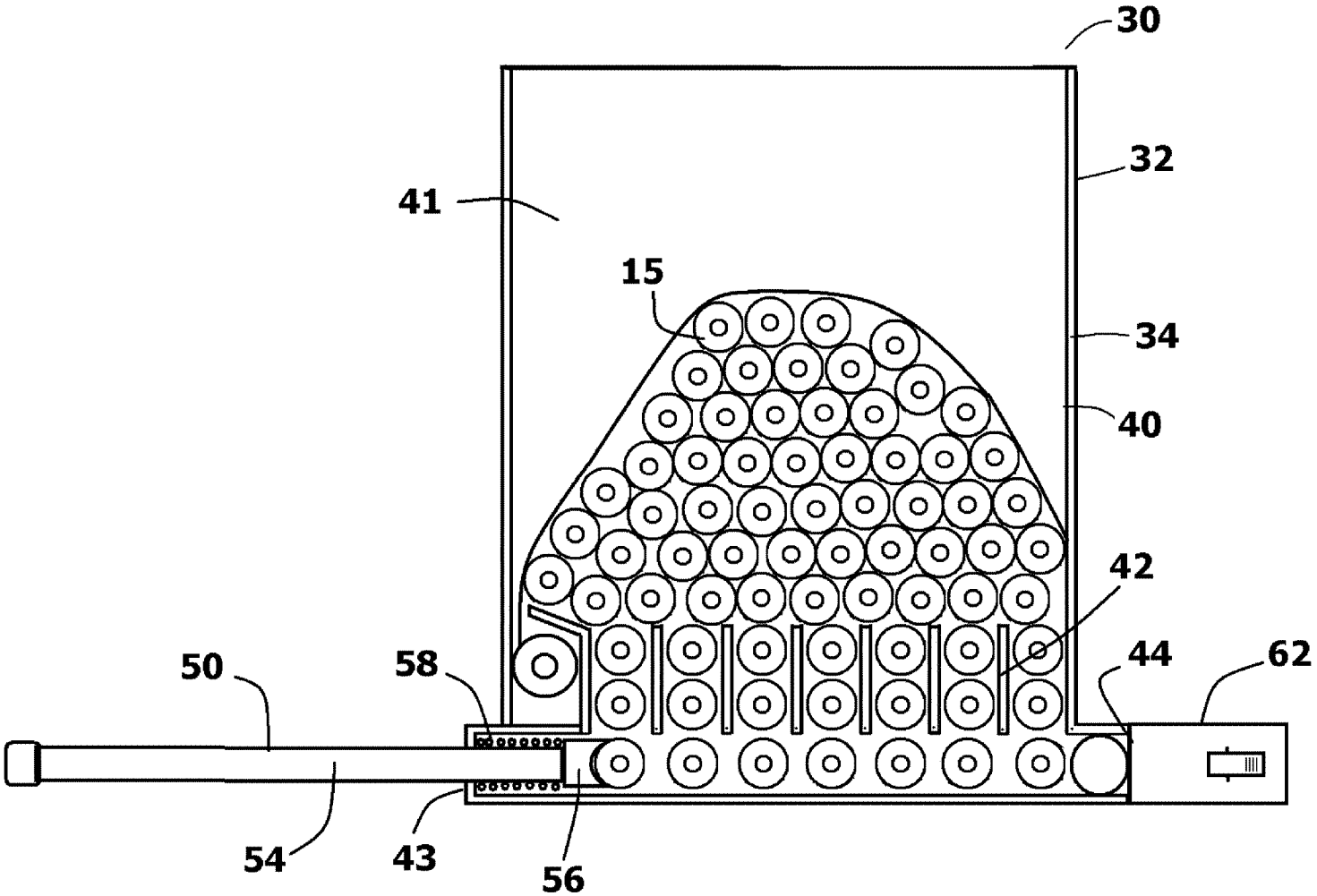
FIG. 4 shows a sectional view of the reloading system of FIG. 3 vied on section line 4-4.
Figure 5:
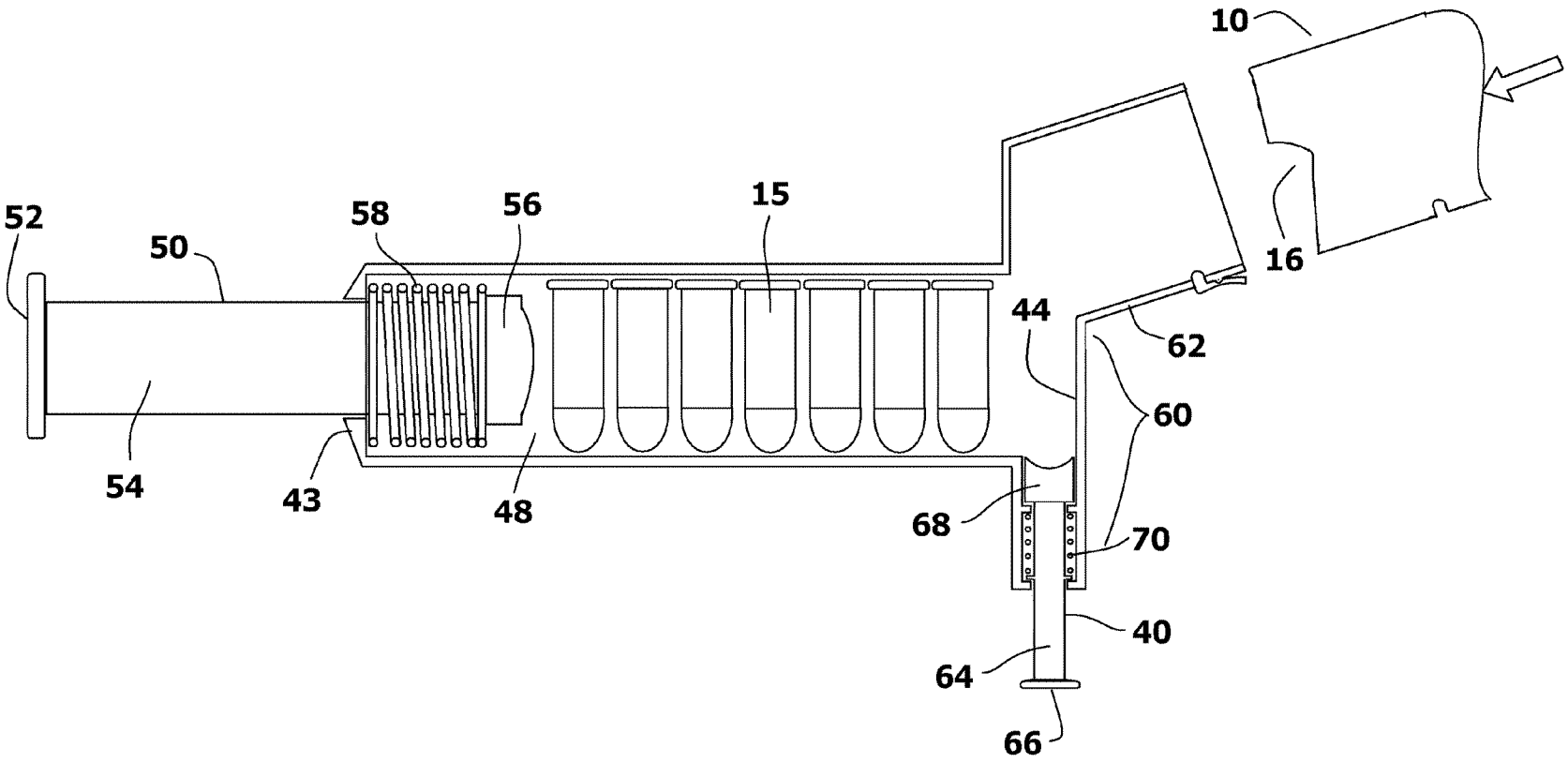
FIG. 5 shows a sectional view of the reloading system of FIG. 3 vied on section line 5-5 without an engaged magazine.
Figure 6:
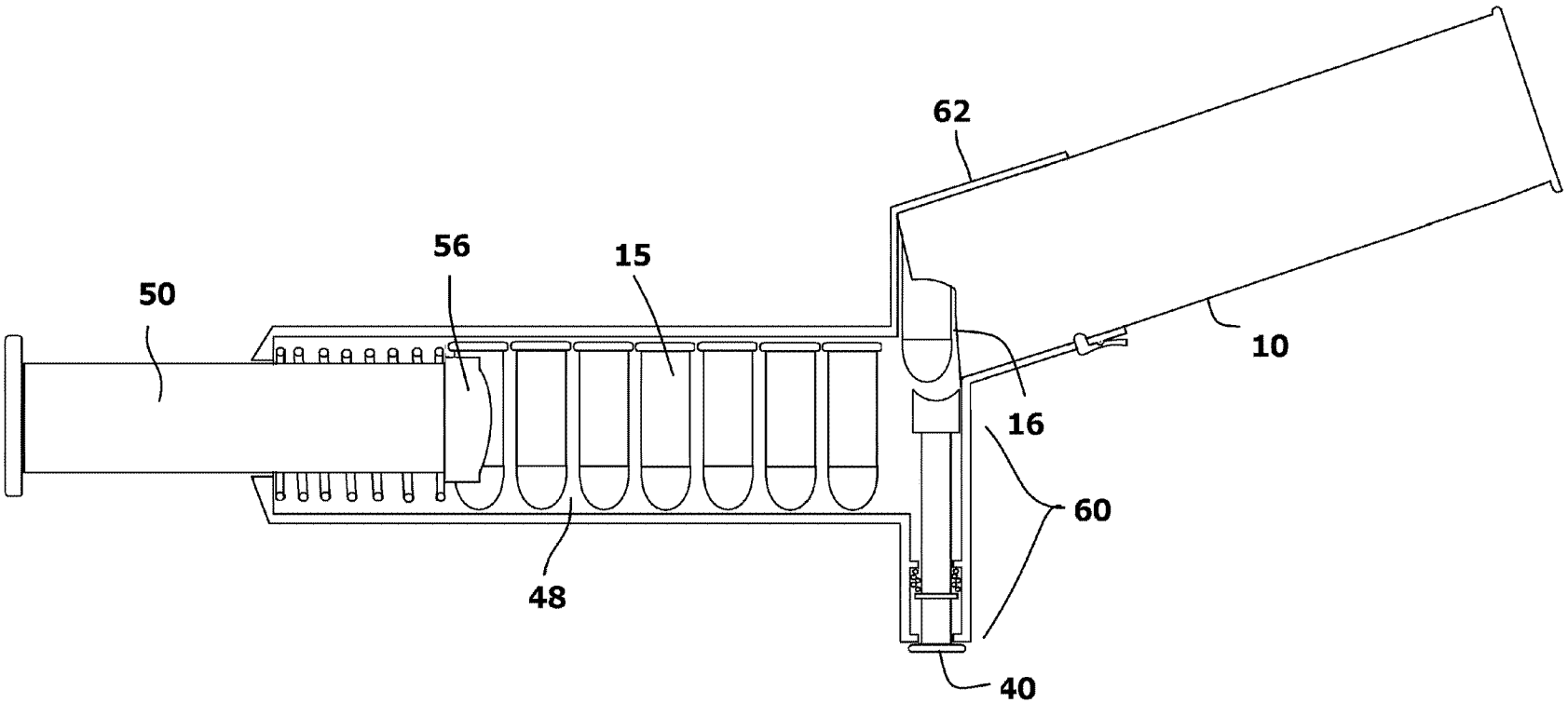
FIG. 6 shows a sectional view of the reloading system of FIG. 3 vied on section line 5-5 with a magazine fully inserted.

Referring to FIG. 4, FIG. 5 and FIG. 6 in conjunction with FIG. 2 and FIG. 3, it can be seen that the storage container 32 defines an internal storage compartment 41. There are isolated spacers 42 positioned low within the storage compartment 40 of the reloading system 30. The spacers 42 are parallel. The number of cartridges 15 that can be stacked within the internal storage compartment 41 is determined by the area available and the size of the cartridges 15.

The spacers 42 separate the main area of the internal storage compartment 41 from a loading chamber 48. The loading chamber 48 is sized to receive a single horizontal line of cartridges 15 that pass between the spacers 42 in the internal storage compartment 41. The loading chamber 48 has a first end 43 and an opposite second end 44. A large plunger 50 is positioned within the loading chamber 48. The large plunger 50 has a handle 52, a shaft 54 and a shaped head 56. The shaped head 56 of the large plunger 50 is biased toward the second end 44 of the loading chamber 48 by a spring 58. However, the shaped head 56 of the large plunger 50 can be moved toward the first end 43 of the loading chamber 48, against the bias of the spring 58, by manually pulling on the handle 52 of the large plunger 50.

A loading mechanism 60 and magazine receptacle 62 are positioned at the second end 44 of the loading chamber 48. The magazine receptacle 62 is shaped and sized to receive the ammunition magazine 10 that is being reloaded. The magazine receptacle 62 is offset from the loading chamber 48 to compensate for the offset angle of the ammunition magazine 10. In this manner, the cartridges 15 that get loaded into the ammunition magazine 10 are parallel to the cartridges in the loading chamber 48.

The loading mechanism 60 includes of the small spring-loaded plunger 40. The small spring-loaded plunger 40 is oriented at a perpendicular to the large plunger 50. The small spring-loaded plunger 40 has a shaft 64. The shaft 64 terminates with a contact flange 66 at one end and a push head 68 at the opposite end. The shaft 64 positions the push head 68 inside the loading chamber 48. The small plunger 40 is biased by a spring 70, wherein the spring 70 biases the shaft 64 of the small plunger out of the loading chamber 48.

The storage container 32 of the reloading system 30 is opened and cartridges 15 are placed into the columns 42. Gravity causes the cartridges 15 to fall toward the loading chamber 48 through the spacers 42. A spring-loaded compression strap 72 can be provided in the internal storage compartment 41 that biases the cartridges 15 toward the loading chamber 48 and prevents the cartridges 15 from misorienting within the storage container 32. When the large plunger 50 is extended within the loading chamber 48, no cartridges 15 can enter the loading chamber 48. However, when the large plunger 50 is manually retracted, an aligned row of cartridges 15 pass into the loading chamber 48. The result is that the loading chamber 48 is filled with cartridges 15, wherein the number of cartridges 15 corresponds to the capacity of the ammunition magazine 10 or an even number fraction of its capacity, such as one-half.

When the retracted large plunger 50 is released, the shaped head 56 of the large plunger 50 contacts the row of cartridges 15 and biases the cartridges 15 toward the loading mechanism 60. The ammunition magazine 10 is advanced into the loading chamber 48 through the loading port 36. The cartridges 15 in the loading chamber 48 are not aligned with the magazine 10. As such, in order to advance a cartridge 15 into the ammunition magazine 10, the small spring-loaded plunger 40 has to be depressed. When the small spring-loaded plunger 40 is depressed, the push head 68 contacts the cartridge 15 and pushes the cartridge 15 out of the loading chamber 48 and into the opening 16 of the ammunition magazine 10. This loads the ammunition magazine 10. The process can be repeated for as long as there is room in the ammunition magazine 10 and cartridges 15 in the loading chamber 48. The speed at which the cycle can be repeated is limited only by how quickly a person can press and release the small spring-loaded plunger 40, which would average between two cycles and three cycles per second.

Once full, the magazine 10 is removed from the loading chamber 48. The large plunger 50 can then be manually retracted. This automatically drops a new row of cartridges 15 into the loading chamber 48 and the reloading system 30 is automatically primed for reuse.

In the primary embodiment, a reloading system 30 is shown that reloads seven cartridges 15 into a magazine 10 each time the magazine 10 is inserted into the reloading system 30. It will be understood that the use of seven cartridges 15 is arbitrary. The reloading system 30 can hold any number of cartridges 15 in the loading chamber 48. Additionally, it should be understood that the same magazine 10 can be inserted into the reloading system 10 multiple times. For example, the reloading system 10 can be configured to present ten cartridges 15 in the loading chamber 48. A magazine may be provided that has a capacity of thirty cartridges 15. To reload the magazine, the large plunger 50 would have to be retracted three times. Each time the large plunger 50 is retracted, ten cartridges 15 are transferred into the loading chamber 48. Accordingly, after three insertions, the magazine would be at capacity.

It will be understood that the embodiment of the present invention that is illustrated and described is merely exemplary and that a person skilled in the art can make many variations to that embodiments. All such embodiments are intended to be included within the scope of the present invention as defined by the claims.

What is claimed is:

1. A reloading system for reloading cartridges into a removable ammunition magazine of a gun, said system comprising:

a loading chamber having a first end and an opposite second end, wherein said loading chamber is configured to retain a numbered set of said cartridges in a common orientation;

a first spring-loaded plunger that extends into said loading chamber from said first end, wherein said first spring loaded plunger biases said numbered set of said cartridges in said loading chamber toward said second end;

a magazine receptacle offset from said loading chamber, wherein said magazine receptacle is configured to receive said ammunition magazine;

a second spring loaded plunger that extends into said loading chamber proximate said second end, wherein said second spring loaded plunger advances one of said cartridges from said numbered set into said ammunition magazine within said magazine receptacle each time said second spring loaded plunger is manually advanced;

a storage container that defines an internal compartment for holding a supply of said cartridges and resupplying said loading chamber each time said first spring loaded plunger is manually retracted.

2. The reloading system according to claim 1, further including a plurality of spacers disposed between said internal compartment and said loading chamber for orienting said numbered set of said cartridges as said plurality of said cartridges pass into said loading chamber from said internal compartment.

3. The reloading system according to claim 1, further including a biasing mechanism in said internal compartment for biasing said cartridges toward said loading chamber.

4. The reloading system according to claim 1, wherein said first spring-loaded plunger has a first plunger shaft that extends in a first direction, and wherein said second spring loaded plunger has a second plunger shaft that extends in a second direction that is perpendicular to said first direction.

5. The reloading system according to claim 1, wherein said first spring-loaded plunger has a plunger head that is biased toward said second end of said loading chamber, wherein said plunger head can be selectively retracted toward said first end of said loading chamber by manually retracting said first spring-loaded plunger.

6. The reloading system according to claim 1, wherein said second spring-loaded plunger has a plunger head that is biased away from said magazine receptacle, wherein said plunger head can be selectively advanced into said magazine receptacle by manually depressing said second spring-loaded plunger.

7. A reloading system for reloading cartridges into an ammunition magazine of a gun, said system comprising:

a container having an internal compartment that leads into a loading chamber;

a magazine receptacle adjacent said loading chamber, wherein said magazine chamber receives and retains said ammunition magazine;

cartridges stored within said container, wherein a set number of said cartridges automatically fill said loading chamber each time said loading chamber is emptied;

a first plunger that extends into said loading chamber and biases said set number of said cartridges in said loading chamber toward said magazine receptacle;

a second plunger that extends into said loading chamber, wherein said second spring loaded plunger advances one of said cartridges from said set number into said ammunition magazine within said magazine receptacle each time said second plunger is manually advanced.

8. The reloading system according to claim 7, further including a plurality of spacers disposed between said internal compartment and said loading chamber for orienting said set number of said cartridges as said cartridges pass into said loading chamber from said internal compartment.

9. The reloading system according to claim 7, further including a biasing mechanism in said internal compartment for biasing said cartridges toward said loading chamber.

10. The reloading system according to claim 7, wherein said first plunger has a first plunger shaft that extends in a first direction, and wherein said second plunger has a second plunger shaft that extends in a second direction that is perpendicular to said first direction.

11. A method of reloading cartridges into a removable ammunition magazine of a gun, said method comprising the steps of:

providing a loading chamber that is accessible through a loading port, wherein said loading chamber is connected to a stored supply of cartridges that fill said loading chamber with some of said cartridges each time said loading chamber is emptied;

providing a first plunger and a second plunger that can be selectively advanced into said loading chamber;

providing spacers in said loading chamber that orient said cartridges present within said loading chamber;

providing a magazine;

inserting said magazine into said loading chamber through said loading port;

advancing said cartridges in said loading chamber toward said magazine with said first plunger; and advancing said cartridges into said magazine with said second plunger.

12. The method according to claim 11, wherein said first plunger is spring biased toward said magazine.

13. The method according to claim 12, wherein said second plunger is spring biased away from said magazine.

* * * * *